US007124684B1

(12) United States Patent
Petersen

(10) Patent No.: US 7,124,684 B1
(45) Date of Patent: Oct. 24, 2006

(54) INK PAD HOLDER FOR SELF-INKING STAMP

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 0 days.

(21) Appl. No.: 11/280,092

(22) Filed: Nov. 16, 2005

(51) Int. Cl.
*B41K 1/54* (2006.01)

(52) U.S. Cl. ..... 101/333; 101/334; 118/264; 118/269

(58) Field of Classification Search ..... 101/327, 101/333, 334, 103, 104, 405, 406; 118/264, 118/269
See application file for complete search history.

(56) References Cited

U.S. PATENT DOCUMENTS 454,499 A * 6/1891 Ryer ..... 101/334
827,347 A * 9/1906 Campbell ..... 101/334
1,085,489 A * 1/1914 Rushworth ..... 101/334
3,020,838 A * 2/1962 Prost ..... 101/333
5,623,875 A * 4/1997 Perets ..... 101/334

FOREIGN PATENT DOCUMENTS

JP 05-330216 A * 12/1993
WO WO 2005/084953 A2 * 9/2005

* cited by examiner

*Primary Examiner*—Leslie J. Evanisko
(74) *Attorney, Agent, or Firm*—Knechtel, Demeur & Samlan

(57) ABSTRACT

An ink pad holder for use with a self-inking reciprocating hand stamp. The ink pad holder has an upper and lower compartment, with an ink pad mounted in each compartment. The ink pad holder can be inserted in the hand stamp with either ink pad facing the printing plate so that different inks can be applied to the printing plate. This allows the user greater versatility such as using the ink pad for finger printing applications by impregnating one of the ink pads with finger printing ink. Alternatively only the lower compartment may have an ink pad mounted therein with the upper compartment remaining empty for storing small items. The ink pad holder is easily removed from the hand stamp so the ink pads are easily accessible for re-inking.

15 Claims, 2 Drawing Sheets

INK PAD HOLDER FOR SELF-INKING STAMP

BACKGROUND AND SUMMARY OF THE INVENTION

This invention relates to hand stamps and more particularly to a self-inking hand stamp that has an ink pad held in the stamp frame that provides ink to the image forming stamp material.

One type of conventional stamp requires manufacturing a stamping member from rubber or other flexible material. The stamping member is mounted on a handle that is grasped by the user. The stamping member is placed into contact with ink, usually contained in an inkpad. The inked stamping member is then pressed against the surface onto which the stamp image is to be transferred. Repetition of the stamping process required that the stamping member be pressed against the inkpad each time an image is to be transferred. This is a disadvantage to the user as it requires extra time for each re-inking step and slows down the stamping process if many stampings are to be done. It also requires the use of an inkpad that is separate from the stamp which must be periodically re-inked.

Another type of stamp uses a stamping member made from a permeable material that allows ink to pass through the stamping member. The ink is held within the stamp and allowed to gradually ooze onto the stamping member. This eliminated the need for a separate stamp inkpad. These stamps are referred to as self-inking stamps.

An example of this stamp is illustrated in U.S. Pat. No. 5,577,444 issued to Toyama. This patent illustrates a hand stamp that has a sealed ink compartment that stores the ink. The ink can be refilled into the compartment by means of removing a threaded screw at the top of the compartment. Once the screw is removed, the ink can be injected, and the screw replaced. The stamping member has a stamping surface with stamping and non-stamping portions.

There are several problems with this type of self inking device. First, depending on the design, it may require adding ink through the top to fill or refill the ink chamber. This is a messy procedure. It also may result in adding too little or too much ink to the ink chamber. Second, the chamber must be sealed to allow the ink to only ooze out through the bottom opening onto the stamp pad. Third, there is no safeguard that minimizes the possibility of the stamping surface inadvertently coming into contact with the image receiving surface and creating an unwanted deposit of ink.

Another type of stamp uses an ink pad held in the stamp frame with a reciprocating image forming stamp mounted below the ink pad. The image forming stamp is held against the ink pad by a spring mechanism. When the image is to be placed on the image receiving material, the user pushes down on the stamp handle which is connected to the image forming stamp. This causes the image forming stamp to rotate 180° while it is being pushed in the direction of the image receiving material. The image forming stamp contacts the image receiving material and transfers the inked image onto the image receiving material. This stamp has the advantage that the ink pad can be removed for replacement or re-inking. A problem is that the ink pad has a limited quantity of ink that it can store. Also the ink pad can only have one color or type of ink in the pad.

Applicant's invention is directed to the stamp design that uses a reciprocating image forming stamp mounted below the ink pad. The invention addresses and solves the problem of the prior art ink pads having only a limited supply of ink and only one type of ink. The invention comprises an ink pad holder or tray that has a central barrier wall that divides the ink pad holder into two separate compartments. This allows the ink pad holder to have one ink pad on one side and a second ink pad, that can be the same or different, on the other side. By simply removing and rotating the ink pad holder, the stamp can print with two different types or colors of ink. Alternatively, the same color ink can be stored on both pads. In an alternate embodiment, an ink pad can be mounted in the lower compartment and the upper compartment can be left empty for storing paper clips, folded paper instructions and other small items. In another alternate embodiment, the thickness of the ink pad holder remains the same but the dividing wall is moved to one side allowing for a double size ink pad that is held by the ink pad holder which doubles the ink carrying capacity of the ink pad and results in substantially more images being made before re-inking is necessary.

OBJECTS AND ADVANTAGES

It is an object to provide a hand stamp that uses an inventive ink pad holder or tray that holds one ink pad on one side of the holder and a second ink pad on the opposite side of the holder. It is a related object to provide an ink pad that holds two different ink pads containing two different inks.

Another object is to provide an ink pad holder that is easily reversible to present the desired ink pad to the stamping member.

Still another object is to provide an ink pad holder with two ink pads separated by a non permeable dividing wall to separate the ink pads from each other.

Yet another object is to provide an ink pad holder that is divided into two compartments with an ink pad in the lower compartment and the upper compartment remaining empty for storing small objects.

The advantage of this invention is that it allows the user to select the desired ink from the two sided ink pad holder and rotate the ink pad holder so that the desired ink contacts the image forming stamp member. This invention also allows one ink to be stored in one compartment for printing and a second ink that is used when the ink pad holder is removed from the stamp. Another advantage is that in an alternate embodiment the ink pad holder has the dividing wall moved to one side so that a double thick ink pad can be placed in the inkpad holder to increase the quantity of ink stored in a single ink pad.

These and other objects and advantages will be apparent from reviewing the following Description of the Drawings and Description of the Preferred Embodiment.

DESCRIPTION OF THE PREFERRED EMBODIMENT

Figure 1:
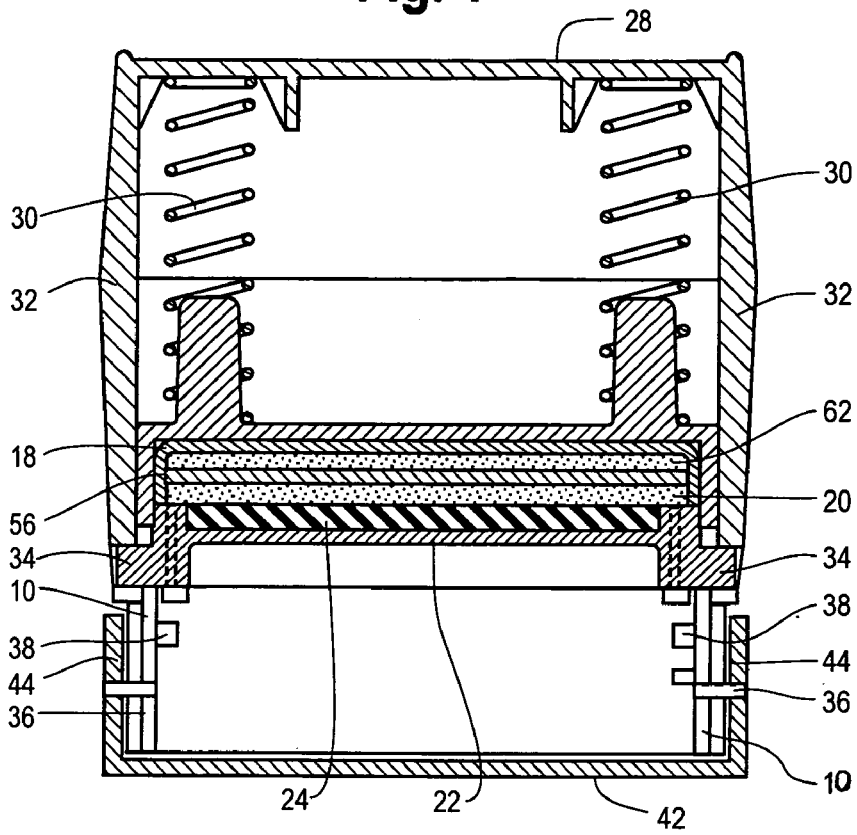
FIG. 1 is a front elevation view of a self-inking hand stamp, in cross section illustrating the orientation of the various parts of the stamp and the inventive ink pad holder.
Figure 2:
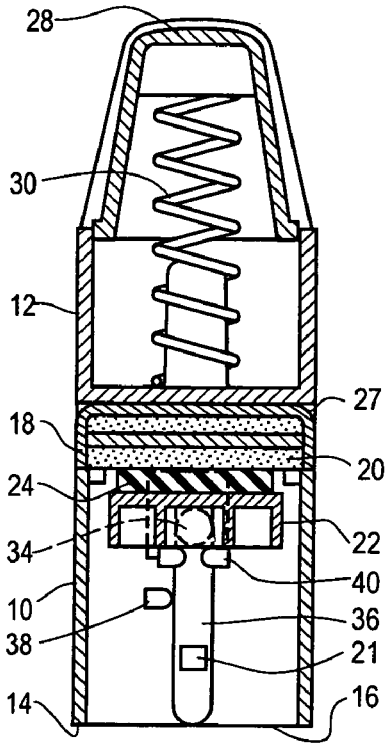
FIG. 2 is side elevation view in cross section illustrating the stamp in the normal non depressed position with the image forming member in contact with the lower ink pad.

Turning first to FIGS. 1 and 2, there is illustrated a self-inking stamp comprising a lower frame part 10 and an upper frame 12. At the bottom of the lower frame is a bottom edge 14 for placing on an image receiving surface 16 to be stamped. There is an ink pad holder 18 which will be more fully described later, but for initial discussion, is seen as retaining a lower ink pad 20. A stamp insert 22 is movable to and fro between the lower ink pad 20 and the image receiving surface 16. The stamp insert 22 supports a printing plate 24 with an image forming surface 26. An actuating handle 28 is at the top of the stamp. The ink pad holder 18 is frictionally received in a slot 27 in the side of the upper frame 12 so that it can be easily slid into and out of the slot 27.

Figure 3:
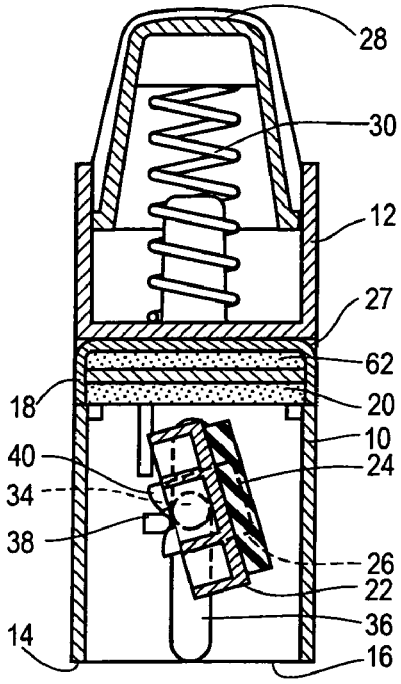
FIG. 3 is a side elevation view similar to FIG. 2 except with the handle partially depressed and the image forming member partially rotated.

In its non-depressed state, the printing plate 24 is held in intimate contact with the lower ink pad 20 by springs 30. The actuating handle 28 surrounds the lower frame part 10 with two side legs 32 and is displaceable towards the image receiving surface 16 by the application of force applied by the user against the handle to overcome the spring force supplied by the springs 30. As seen in FIG. 3, the stamp insert 22 rotates about a turning pivot 34 mounted in the ends of the side legs 32. This turning pivot 34 passes through a substantially vertical guide or channel 36 formed in the narrow side walls of the lower frame part 10. In the lower frame part 10, there is arranged in the region of its narrow side walls a fixed roll-off stop 38. There is a gear member 40 that moves the stamp insert 22. The gear member 40 interacts with the roll-off stop 38 so that when the actuating handle 28 is depressed it causes a 180° flip-over movement of the stamp insert 22 with the roll-off stop 38 in the manner of a rack and pinion gear. This causes the printing plate 24 to have the image forming surface 26 oriented in a face down position to transfer the image from the image forming surface 26 on the printing plate 24 to the image receiving surface 16.

The self-inking stamp also has a bottom cover 42 with at least two side legs 44 that is received by the lower frame part 10 and the image receiving surface 16. Optional features may also be present. For example, the stamp may include a latch and corresponding notches to hold the stamp insert 22 in the depressed or non-depressed states. A top cover that complements the bottom cover 42 to completely enclose the stamp for storage may also be present.

Figure 4:
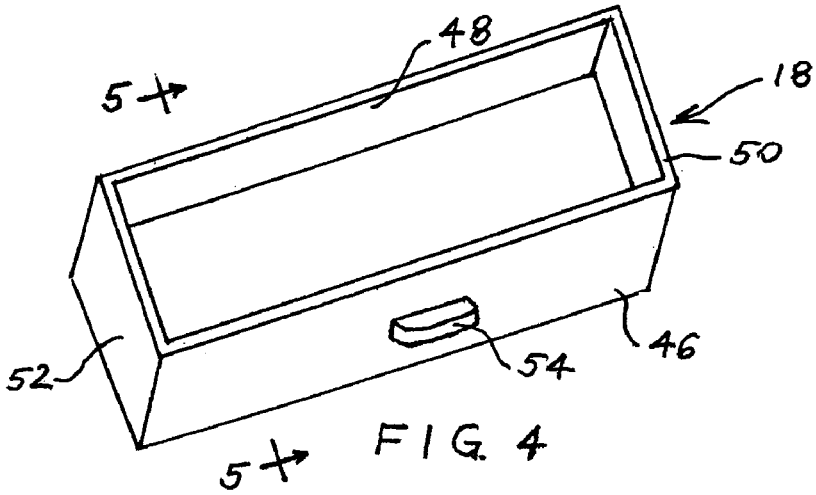
FIG. 4 is a perspective view of the ink pad holder removed from the hand stamp with the ink pad removed from the holder.
Figure 5:
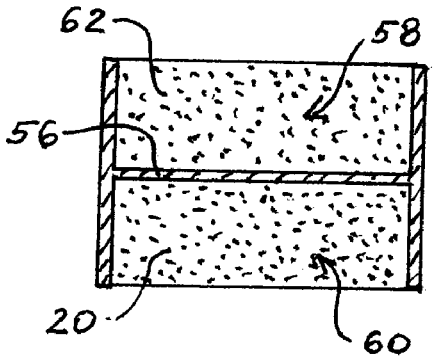
FIG. 5 is a cross sectional view taken along line 3–3 of FIG. 2 illustrating the two compartments in the ink pad holder with the two ink pads inserted.

The ink holder 18 is more clearly illustrated in FIG. 4, wherein it has been slid out from the lower frame part 10. The ink pad holder 18 has a front wall 46, a back wall 48 and opposite side walls 50, 52. Optionally there can be provided a grasping tab 54 located on the front wall 46 to make it easier to remove the ink pad holder 18 from the upper frame 12. As seen in FIG. 5, there is a central divider plate 56 that divides the ink pad holder 18 into two compartments, an upper compartment 58 and a lower compartment 60. The upper and lower compartments 58, 60 can be made the same size or different sizes depending on the particular requirements of the ink pads that are to be placed therein. As seen in FIG. 5 the lower ink pad 20 is mounted in the lower compartment 60 and there is an upper ink pad 62 mounted in the upper compartment 58. The ink pads 20 and 62 can be the same type or color of ink or can be different. For example, both of the ink pads can have black ink or one of the ink pads can have black ink and the other can have red ink. As the ink pad holder 18 is designed so that it can be inserted into the slot 27 with either of the compartments oriented as the upper or lower compartment, either compartment with its respective ink pad can be placed in contact with the printing plate 24. If the ink pad holder 18 has two different color ink pads, by removing and rotating the ink pad holder 18 180°, the desired ink pad is presented to the printing plate 24. This results in more images being printed before re-inking by merely rotating the ink pad holder 18.

Alternatively, the lower compartment 60 may have an ink pad of any color for transferring an image in printing and the upper compartment 58 can have a different type of ink pad and ink, such as one used for finger printing. When the stamp is used for printing an image, the lower ink pad 20 impregnated with the colored ink is oriented facing downward and in contact with the printing plate 24. To use the finger printing ink pad, the ink pad holder 18 is slid out from the upper frame 12 so that the finger printing ink pad is exposed for use. The finger printing pad is generally more rigid and has a different type of ink in it and is located in the upper compartment 58. After the finger printing is finished, the ink pad holder 18 is re-inserted back into the upper frame 12.

Figure 6:
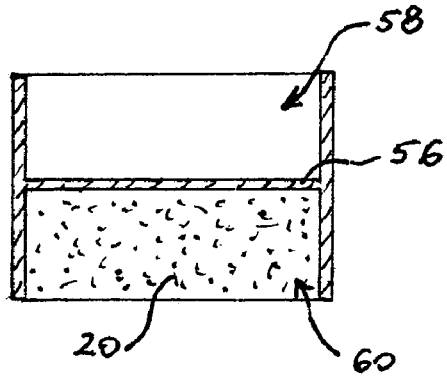
FIG. 6 is a cross sectional view similar to FIG. 5 of an alternate embodiment of the ink pad holder having only one ink pad mounted in the lower compartment and the upper compartment empty.

The ink pad holder 18 can also be used with only one of the ink pads placed in either the upper or the lower compartment 58, 60. As seen in FIG. 6, the other compartment is left empty and is used to store small items such as paper clips, pins, tacks or pieces of paper. It can also have padding in it so that it can hold fragile items or miniature computer memory storage devices. It is preferable that the ink pad be placed in the lower compartment 60 so that the printing plate 24 contacts the ink pad. Then the upper compartment 62 will not have an ink pad installed in it so that it remains empty for storage of the small items.

Figure 7:
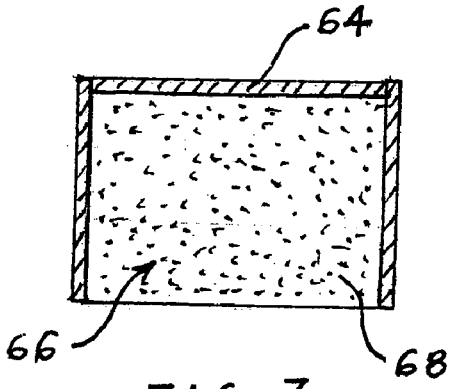
FIG. 7 is a cross sectional view of an alternate embodiment in which the central dividing wall is removed and one thick inkpad in mounted in the ink pad holder.

In an alternate embodiment as seen in FIG. 7, the central dividing plate is removed and replaced with a top plate 64 placed at the top of the ink pad holder 18. This results in one larger compartment 66 that contains a large ink pad 68. This results in an increased quantity of ink stored in the ink pad 68 which allows more ink images to be created before re-inking the ink pad 68. The ink pads are held in their respective compartments by conventional means such as adhesives or mechanical latching means.

Thus there has been provided a stamp pad holder for use in a self-inking hand stamp that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An ink pad holder for a hand stamp comprising:

an ink pad frame member having a front, back and opposite sides and an open top and an open bottom, a divider plate mounted to the front, back, and opposite sides of the ink pad frame dividing the frame between the open top and open bottom and forming an upper compartment with an open top and a lower compartment with an open bottom; and an ink pad mounted in at least one of the compartments.

2. The ink pad holder of claim 1 and further comprising a second ink pad mounted in the other compartment.

3. The ink pad holder of claim 2 wherein the ink pad is saturated with one color ink and the second ink pad is saturated with a second color ink.

4. The ink pad holder of claim 1 wherein the divider plate divides the top and bottom substantially in half forming the upper and lower compartments of substantially the same size and the divider plate restricts the flow of ink from one compartment to the other.

5. The ink pad holder of claim 1 and further comprising a grasping tab on one of the front, back or opposite sides.

6. The ink pad holder of claim 1 wherein the ink pad is mounted in the lower compartment and the upper compartment is adapted for storage.

7. An ink pad holder for use in a self-inking hand stamp that has a reciprocating printing plate, the ink pad holder comprising:

an ink pad frame member having an upper compartment and a lower compartment;

a first ink pad mounted in the upper compartment;

a second ink pad mounted in the lower compartment;

the ink pad frame member adapted for mounting in the self-inking stamp with either the upper or lower compartment facing the reciprocating printing plate so that either the first or second ink pad contacts the reciprocating printing plate for transferring ink from the respective ink pad to the reciprocating printing plate.

8. The ink pad holder of claim 7 wherein the first ink pad is saturated with one color ink and the second ink pad is saturated with a second color ink.

9. The ink pad holder of claim 7 and further comprising a grasping tab on the ink pad frame member.

10. The ink pad holder of claim 7 and further comprising a divider plate between the upper and lower compartments that restricts the flow of liquids between the two compartments.

11. An ink pad holder for use in a self-inking hand stamp that has a reciprocating printing plate, the ink pad holder comprising:

a substantially rectangular ink pad frame member;

an upper compartment in the ink pad frame member having perimeter walls, a bottom, and an open top;

a lower compartment in the ink pad frame member having perimeter walls, a top, and an open bottom, the bottom of the top compartment and the top of the bottom compartment being a common member;

a first ink pad mounted in the upper compartment;

a second ink pad mounted in the lower compartment;

the ink pad frame member adapted for mounting in the self-inking stamp with either the upper or lower compartment facing the reciprocating printing plate so that either the first or second ink pad contacts the reciprocating printing plate for transferring ink from the respective ink pad to the reciprocating printing plate.

12. The ink pad holder of claim 11 wherein the bottom of the upper compartment and the top of the lower compartment are integrally formed of one continuous piece.

13. The ink pad holder of claim 11 wherein the first ink pad is saturated with one color ink and the second ink pad is saturated with a second color ink.

14. The ink pad holder of claim 11 and further comprising a grasping tab on the ink pad frame member.

15. The ink pad holder of claim 11 wherein the upper and lower compartment are mirror images of each other.

* * * * *